US007216445B2

(12) United States Patent
Bruegmann

(10) Patent No.: US 7,216,445 B2
(45) Date of Patent: May 15, 2007

(54) METHOD AND APPARATUS FOR DISPLAYING A SIGN

(76) Inventor: Malte Bruegmann, 6736 Mantissa Dr., Plano, TX (US) 75023

( * ) Notice: Subject to any disclaimer, the term of this patent is extended or adjusted under 35 U.S.C. 154(b) by 0 days.

(21) Appl. No.: 10/700,758

(22) Filed: Nov. 3, 2003

(65) Prior Publication Data

US 2005/0091893 A1 May 5, 2005

(51) Int. Cl.
*G09F 15/00* (2006.01)

(52) U.S. Cl. ..... 40/606.15; 248/454

(58) Field of Classification Search ..... 40/606.15, 40/750, 754, 786, 788; D20/43; 248/441.1, 248/447, 454, 455; 211/119.003; 108/27, 108/60, 90

See application file for complete search history.

(56) References Cited

U.S. PATENT DOCUMENTS

| | | | | |
|---|---|---|---|---|
| 769,868 | A * | 9/1904 | May | 40/606.15 |
| 2,506,189 | A * | 5/1950 | Attridge | 273/157 R |
| 4,466,592 | A | 8/1984 | Janson | |
| 4,901,969 | A * | 2/1990 | Yaeger | 248/455 |
| 5,289,652 | A | 3/1994 | Kringel et al. | |
| 5,375,803 | A | 12/1994 | Kump | |
| 5,664,749 | A | 9/1997 | Kump et al. | |
| 5,722,628 | A * | 3/1998 | Menaged | 248/441.1 |
| 5,832,644 | A | 11/1998 | Mason | |
| 5,924,367 | A | 7/1999 | Henke et al. | |
| 5,933,992 | A | 8/1999 | Padiak et al. | |
| 5,979,674 | A | 11/1999 | Thalenfeld | |
| 6,044,982 | A | 4/2000 | Stuart | |
| 6,108,956 | A | 8/2000 | Conway et al. | |
| 6,202,334 | B1 | 3/2001 | Reynolds et al. | |
| 6,338,212 | B1 | 1/2002 | Santa Cruz et al. | |
| 6,354,546 | B1 | 3/2002 | Mueller | |
| 6,412,204 | B1 | 7/2002 | Shoemaker et al. | |
| 6,434,871 | B2 | 8/2002 | Conway | |
| 6,435,466 | B1 * | 8/2002 | Adams | 248/455 |
| 6,457,689 | B1 | 10/2002 | Padiak et al. | |
| 6,490,820 | B1 | 12/2002 | Weakley | 40/651 |

FOREIGN PATENT DOCUMENTS

| | | | |
|---|---|---|---|
| GB | 2086116 A | * | 5/1982 |
| GB | 2186729 A | * | 8/1987 |

OTHER PUBLICATIONS

Miscellaneous Web page.

* cited by examiner

*Primary Examiner*—Joanne Silbermann
(74) *Attorney, Agent, or Firm*—Winstead PC

(57) ABSTRACT

A multi-positionable display apparatus includes a mounting plate, a sign holder, a latching mechanism, and a flexible hinge coupling the mounting plate to the sign holder. The sign may be displayed on a flat surface, such as a box, or may be displayed freely hanging from a store shelf or the like. When hanging from a store shelf, the multi-positionable display allows removal of items from lower shelving without the removal of the multi-positionable display from the shelving.

18 Claims, 7 Drawing Sheets

METHOD AND APPARATUS FOR DISPLAYING A SIGN

BACKGROUND OF THE INVENTION

1. Technical Field of the Invention

The present invention relates to displays, and, more particularly, but not by way of limitation, to a method and apparatus for mounting a sign adjacent to a generally flat surface, such as a store shelf or the like.

2. Description of Related Art

Displays and signs have become popular in all manner of retail trades. For example, displays may be utilized on store shelving, such as grocery store shelves and the like. Such signs can be particularly effective marketing tools when properly designed and utilized. A large number of displays are currently available on the market. These displays vary from the active-type, such as rotating signs for eyeglasses and the like, to common passive types of signs, such as overhead displays. In a well-recognized arrangement, the signs are positioned on store shelves upon which the goods are stocked, or on the vertical standards that support the shelves. In this manner, the signs are used to direct a consumer's attention to the particular goods or items placed on the shelves.

One effective way to direct a consumer's attention to particular goods or items within a store is to place the signs at the front of the shelves or on top of the product or its box. One known type of sign that is positioned near the goods to be displayed is permanently affixed to the store shelf front. While such a sign is effective at directing a customer's attention to particular items or products that are located on or below the store shelf, such signs are generally affixed to the store shelf creating difficulty in removing products and restocking the store shelf. Additionally, permanently affixed signs can be easily damaged if due care is not exercised when removing products or restocking the shelves. Another known type of sign system includes a mounting portion that is permanently affixed to, for example, a vertical shelf standard, and includes an arm that extends from the mounting bracket and has a pivoting head at the end of the arm. The sign is mounted to the pivoting head to permit the sign to be moved out of the way during product removal and shelf restocking. A disadvantage to this particular display arrangement is that there are many small hardware items that are necessary for assembling the sign, and many of the hardware items must be removed in order to pivot the sign out of the way from its normal display position to the access position for accessing the store shelf.

In many known shelving arrangements, the shelves extend from vertical support posts having partition walls extending between and connecting the posts. The shelves rest on brackets or supports that extend from both sides of the face of the partition wall behind the shelves. Another type of display extends upwardly from the top of the partition walls at a height above the floor that provides increased visibility over greater distances.

While known sign systems often can be effective in directing a consumer's attention to a particular product or store shelf location, such systems have deficiencies. First, as with the store shelf mounted displays discussed above, these display systems may be relatively inflexible in that they cannot be installed in more than one manner on a particular shelving system. Second, because differences between such display systems, the installation hardware typically varies from one system to another. Interchangeability is therefore limited. This deficiency may result in increased costs for maintaining a large quantity of different display types along with the respective mounting hardware. This may result in having an insufficient stock of the proper display to, for example, advertise a sale or special item. Accordingly, there is a need for a flexible sign mounting system that permits a display to be mounted to commonly used shelving systems in a variety of configurations.

SUMMARY OF THE INVENTION

Embodiments of the present invention permit a sign to be mounted to the front surface of a store shelf (or other generally horizontal surface) as well as standing on the product or its box. Emodiments of the present invention comprise a single component that can be adjusted to fit various types of installation arrangements and permits the sign to be installed with minimal hardware and tools.

The present invention relates to displays, and, more particularly, one aspect of the invention relates to a multi-positionable display apparatus with a mounting plate, a flexible hinge extending at least partially along a width of the mounting plate, and a sign holder coupled to the mounting plate by the flexible hinge. A latching mechanism is provided which extends partially along adjacent borders of the sign holder and the mounting plate. The latching mechanism is adapted for positioning the sign holder in one of at least two positions relative to the mounting plate.

In yet another aspect, the latching mechanism positions the sign holder at an angle of about 115 degrees relative to the mounting plate when the latching mechanism is engaged and the apparatus is displayed on a generally flat surface. In another aspect, The latching mechanism positions the sign holder at an angle of about 90 degrees relative to the mounting plate when the latching mechanism is disengaged and the sign holder is freely hanging from the mounting plate.

In another aspect, the multi-positionable display is extruded as a single apparatus during the manufacture of the apparatus, and is formed of an extruded plastic compound. In yet another aspect, the mounting plate includes a plurality of holes for affixing the mounting plate to a surface upon which the sign is to be displayed. In another aspect, the display includes a generally u-shaped channel extending at least partially along a length of the sign holder and adapted for receiving a sign.

In still another aspect, the latching mechanism further includes a pair of complimentary positioning anchors, with each of the pair of complimentary positioning anchors coupled along the adjacent borders of the sign holder and the mounting plate. At least one of the complementary positioning anchors aligns the sign such that the sign is generally parallel to an edge of the surface upon which the mounting plate rests when the sign holder is freely hanging from the mounting plate.

The multi-positionable display according to principles of the present invention may have many advantages over the known prior art. First, the multi-positionable display requires generally fewer parts than the displays known in the art. Second, when mounted on a shelving system, the multi-positionable display allows easier access to items on a lower store shelf than the displays in the known prior art. Third, the multi-positionable display may be displayed in one of two positions, allowing a retailer to minimize the variety of displays the retailer must keep on hand.

BRIEF DESCRIPTION OF THE DRAWINGS

Principles of the present invention will now be described in more detail with reference to preferred embodiments of the present invention, given by way of examples, and illustrated in the accompanying drawings, in which.

DETAILED DESCRIPTION OF PREFERRED EXEMPLARY EMBODIMENTS OF THE INVENTION

Principles of the present invention will now be described more fully hereinafter with reference to the accompanying drawings, in which exemplary embodiments of the invention are shown. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

Figure 1:
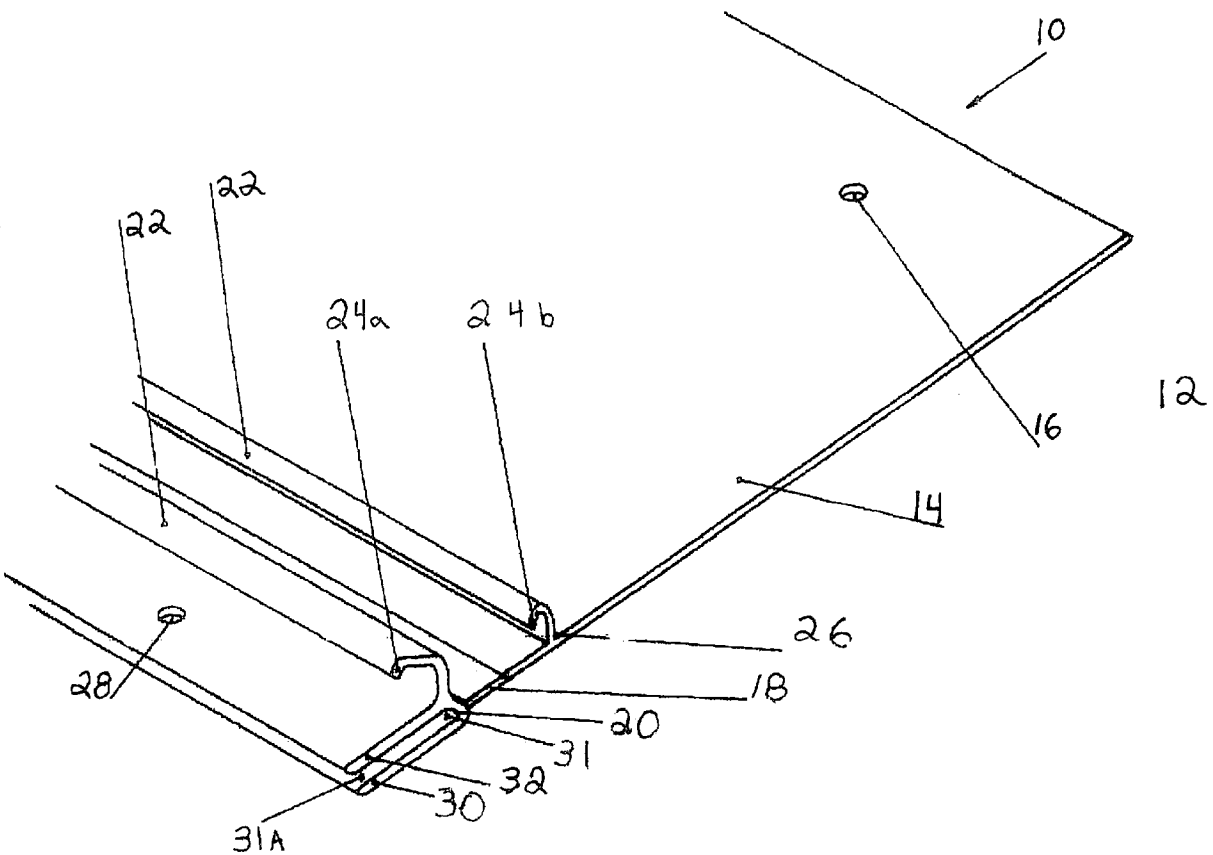
FIG. 1 is a perspective view of a multi-positionable display laying on a generally flat surface.

With reference to FIGS. 1–6, the present invention relates to a multi-positionable display, which is capable of displaying a sign in at least two positions: Referring now to FIG. 1, there is illustrated a perspective view of a multi-positionable display 10 according to principles of the present invention. The display 10 comprises a mounting plate 14, a flexible hinge 18, and a sign holder 20. The mounting plate 14 comprises a plurality of mounting holes 16 for securing the display 10 to a shelf, a wall, or some other surface. In an exemplary embodiment, the sign holder 20 may include a generally u-shaped channel structure 31, with the sign placed within the u-shaped channel 31*a* defined between a surface 30 and a surface 32. Securement holes 28, which extend throughout the thickness of surfaces 32 and 30 of sign holder 20, secure the sign in a fixed position. Further, a latching mechanism 22, which comprises a pair of complimentary positioning anchors 24*a* and 24*b*, is provided for positioning the sign relative to a surface. As will be described in relation to FIGS. 2A-6, the positioning anchors 24*a* and 14*b* are utilized to position the sign holder 20 in at least two positions relative to the mounting plate 14.

In FIG. 1, the display 10 is shown lying open on a surface 12. However, as will be discussed later, the display 10 may be placed in several exemplary display positions. One exemplary embodiment illustrated in FIGS. 2A and 4 displays a sign at an angle of about 115 degrees from the surface upon which the display 10 is placed. Another exemplary embodiment illustrated in FIGS. 2B and 3 displays the sign in a hanging position at an angle of about 90 degrees from the mounting plate 14. However, depending on the design of the positioning anchors, the sign may be displayed in any of a number of positions so as to maximize visibility of the sign to a consumer.

Figure 2A:
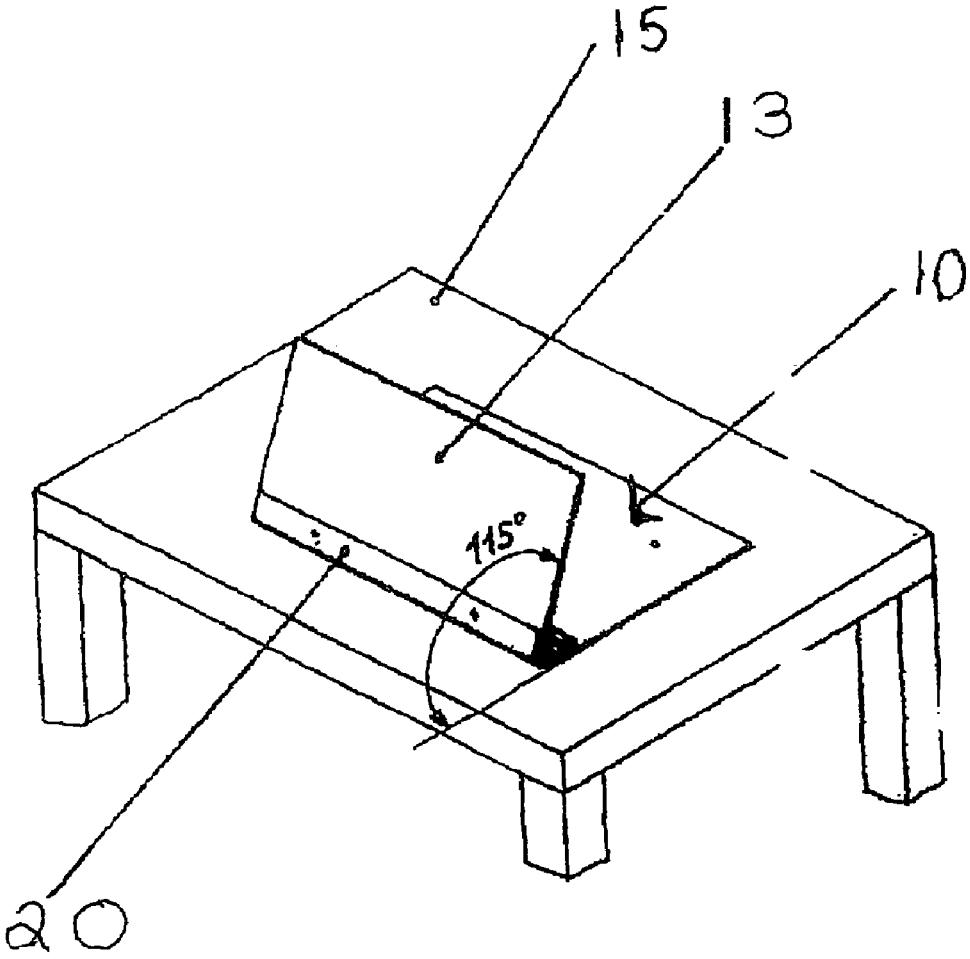
FIGS. 2A and 2B illustrate various uses of the multi-positionable display according to principles of the present invention.
Figure 2B:
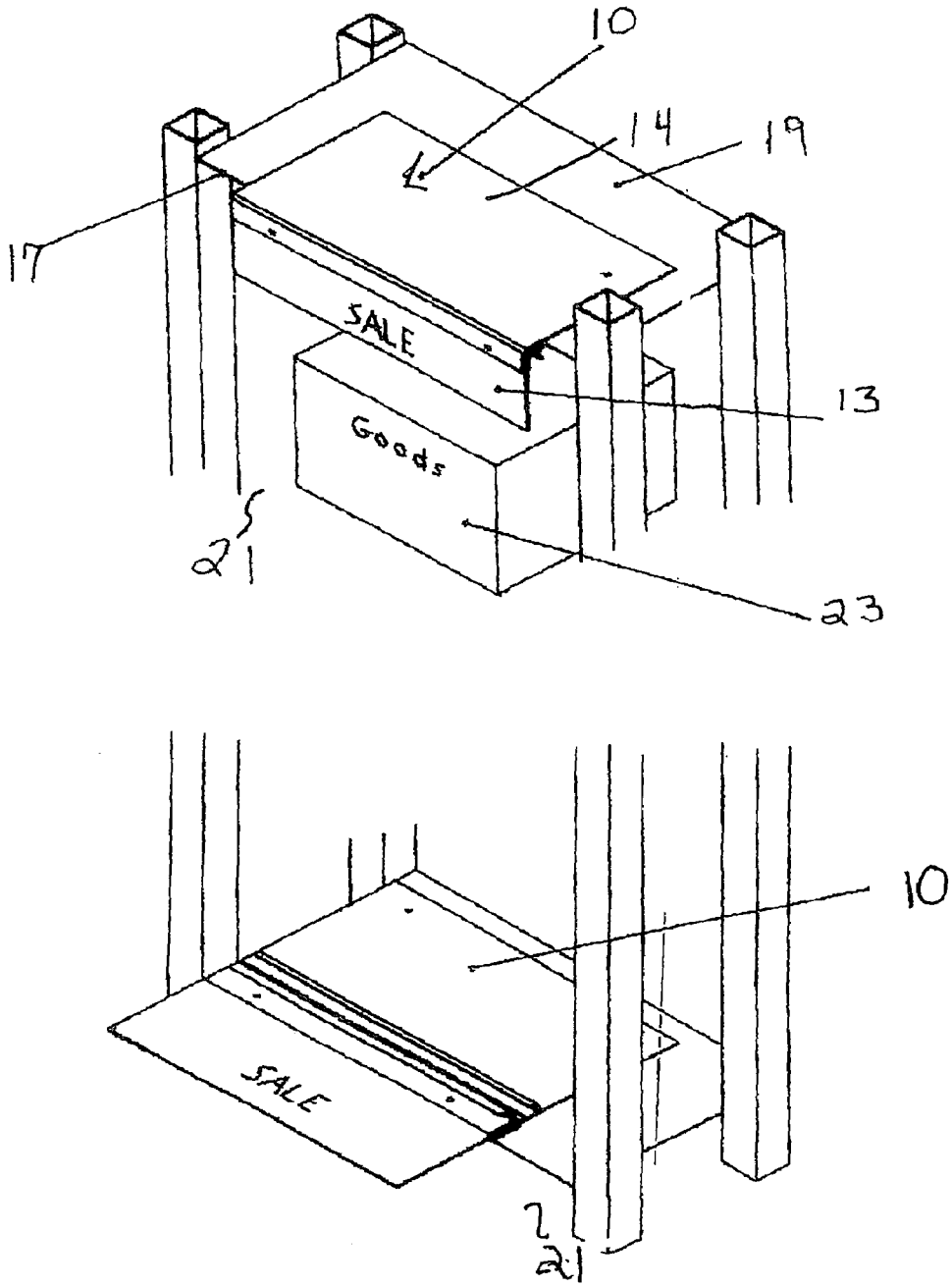

Referring now to FIGS. 2A and 2B in combination, there are illustrated various embodiments of the multi-positionable display 10 according to principles of the present invention. The embodiments illustrated in FIGS. 2A and 2B are discussed in more detail in relation to FIGS. 3 and 4.

Referring specifically now to FIG. 2A, there is illustrated an exemplary embodiment of the multi-positionable display 10 displaying a sign 13 on a flat surface 15. The sign holder 20 may be locked into position via the latching mechanism 22. As mentioned above, when the latching mechanism 22 is engaged, the sign 13 may be displayed at an angle of about 115 degrees relative to the surface 15. The embodiment illustrated in FIG. 2A may be desirable in advertising a variety of types of furniture or other goods which are not readily displayed on store shelving.

With reference now to FIG. 2B, there is illustrated another exemplary embodiment of the multi-positionable display 10 according to principles of the present invention. In this embodiment, the display 10 displays the sign 13 freely hanging from a shelving system 17. The shelving system 17 may be of the type commonly found in grocery stores and department stores. The disengaged latching mechanism 22, which comprises the pair of complimentary positioning anchors 24*a* and 24*b*, ensures that the sign holder 20 is displayed at an angle of about 90 degrees relative to the mounting plate 14. As will be discussed later in relation to FIG. 5, the pair of complimentary positioning anchors 24*a* and 24*b* are designed such that when positioning anchor 24*a* rests upon positioning anchor 24*b*, the angle between the sign holder 20 and mounting plate 14 is about 90 degrees. If the sign is planer with the u-shaped channel 31*a* of FIG. 1, the sign 13 will also be displayed at an angle of about 90 degrees relative to the mounting plate 14. Further, the hinge 18 allows the sign holder 20 to swing freely from an angle of about 90 degrees to the mounting plate to a position which is generally parallel to the mounting plate. This allows a customer to remove a package 23 from the lower shelving 21 without removing the display 10 from the shelving system 17.

Figure 3:
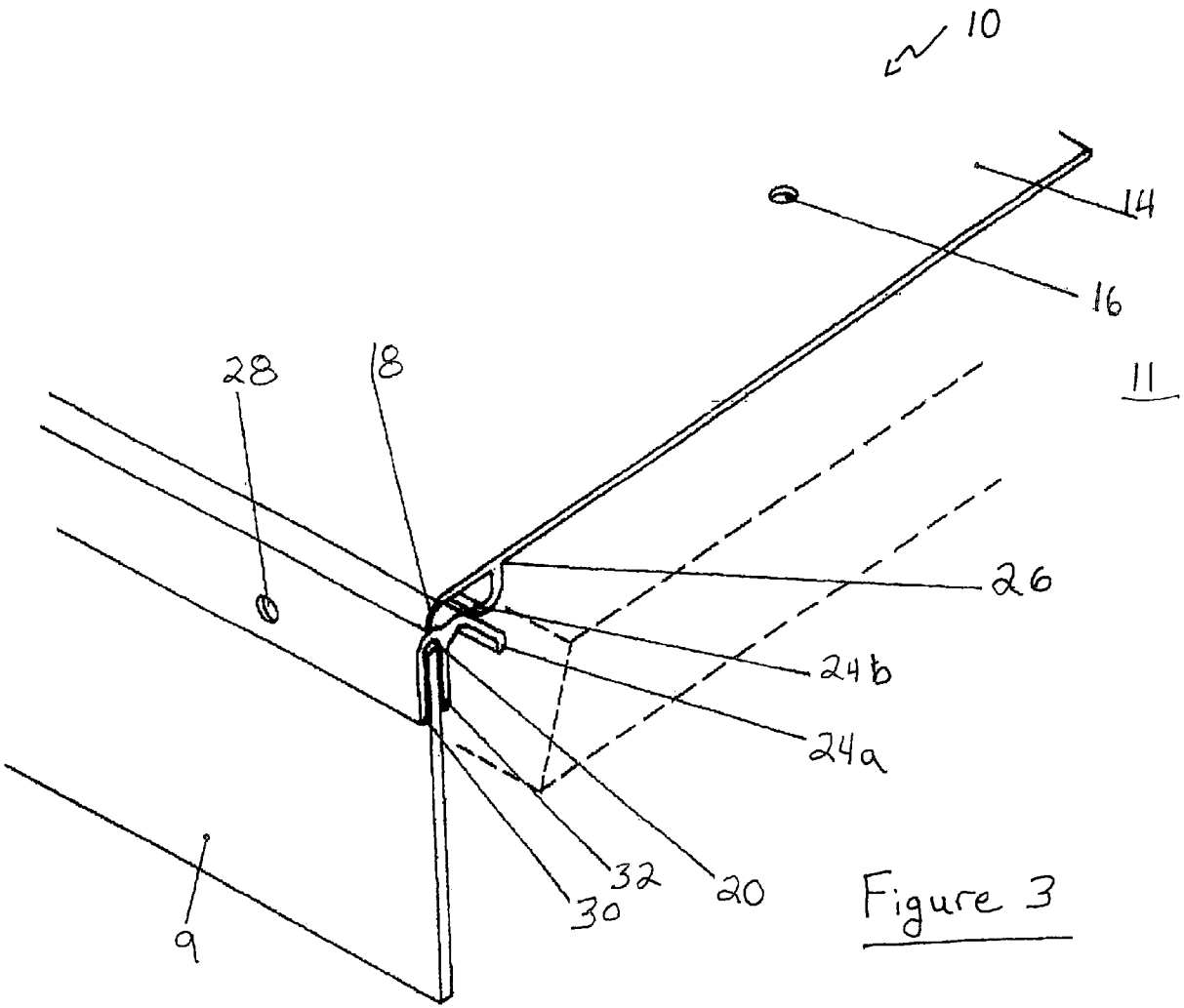
FIG. 3 is perspective of the multi-positionable sign holder of FIG. 1, illustrating the device in use hanging a sign from a store shelf.

Referring now to the exemplary embodiment of the invention illustrated in FIG. 3, the multi-positionable display 10 may be placed such that the sign holder 20 displays a sign 9 hanging from a store shelf 11 (also illustrated in FIG. 2B). In this embodiment, the sign 9 hangs at an angle of about 90 degrees from the mounting plate 14. A surface 26 of positioning anchor 24*b* coupled to the mounting plate 14 may be operable to align the sign holder 20 to the store shelf 11. The sign holder 20 is held by gravity in a plane that is parallel to the plane of the front face of the store shelf 11.

Figure 4:
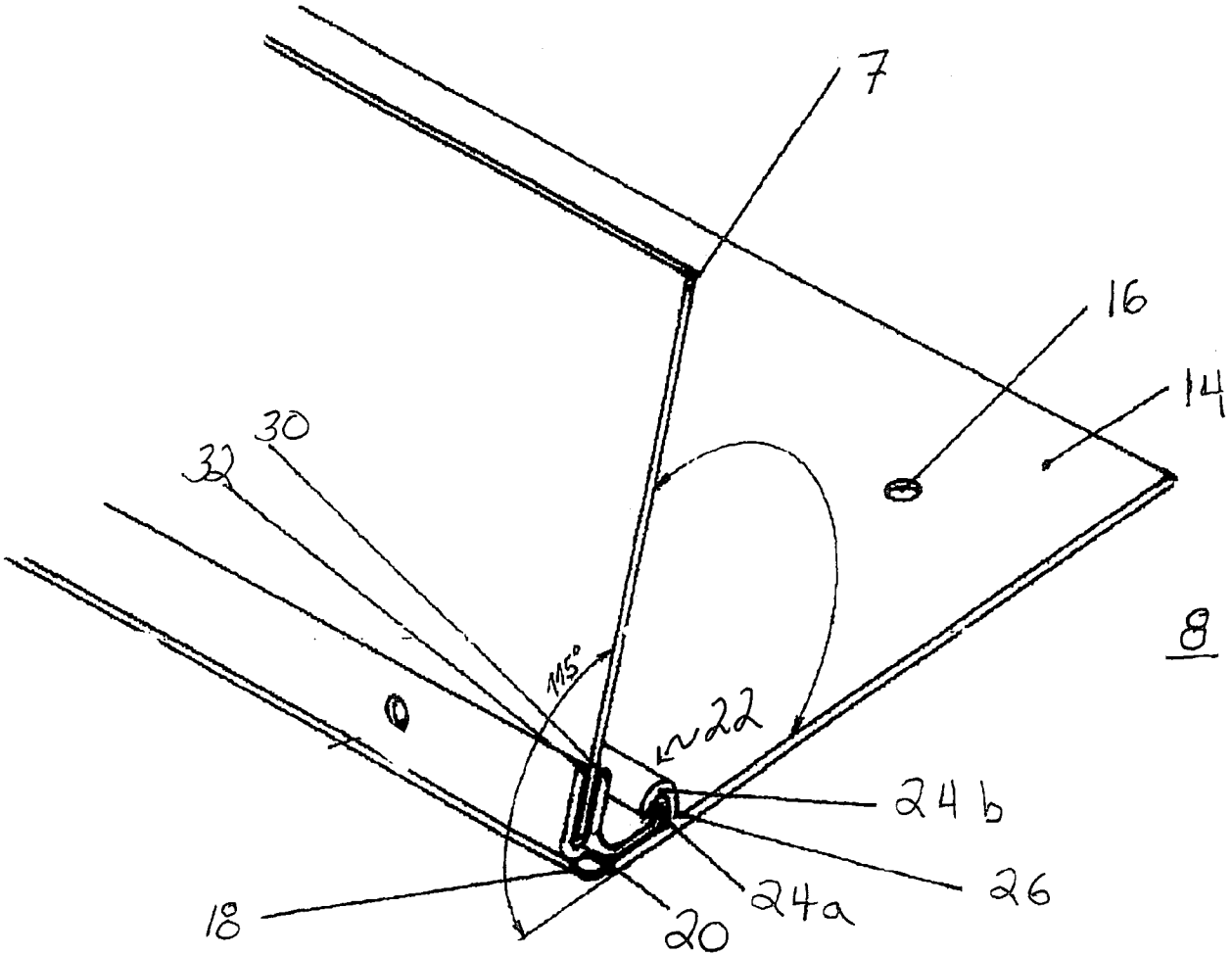
FIG. 4 is a perspective view of the multi-positionable display, illustrating the device holding a sign in a fixed position on a generally flat surface.

Another exemplary embodiment of the multi-positionable display 10 of FIG. 1 is illustrated in FIG. 4. In this particular embodiment, the display 10 is placed on a flat surface 8 and displays a sign 7 in a fixed position relative to the mounting plate (also illustrated in FIG. 2A). The latching mechanism 22 comprises the pair of complimentary positioning anchors 24*a* and 24*b* engaged one to the other. This design of the pair of complementary positioning anchors 24*a* and 24*b* allows the sign to be displayed at an angle of about 115 degree relative to a flat surface 8, as shown in FIG. 4.

Figure 5:
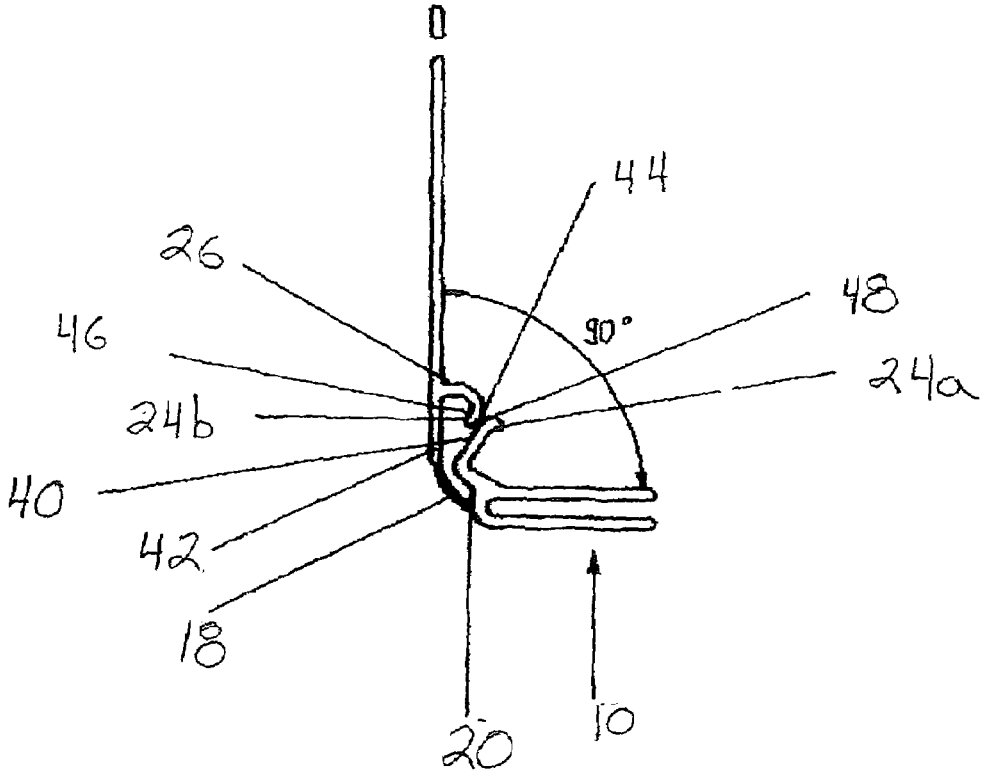
FIG. 5 is a side view of the latching mechanism according to principles of the present invention.

With reference now to FIG. 5, and, in particular, to latching mechanism 22 of FIGS. 1–4, there is shown the pair of complementary positioning anchors 24*a* and 24*b*. In the exemplary embodiment illustrated in FIG. 3, with the multi-positionable display 10 displaying a sign hanging from a store shelf, a surface 48 of complementary positioning anchor 24*a* and a surface 50 of complementary positioning anchor 24*b* are engaged one to the other with surface 48 resting upon surface 50. Disengagement of surface 48 with surface 50 positions the sign holder 20 at a position of about 90 degrees from the mounting plate 14. When, however, a sign is displayed with mounting plate 14 on a generally flat surface, a surface 44 of positioning anchor 24*a* and a surface 46 of the complementary positioning anchor 24*b* are engaged one to the other. A generally flat surface 40 of positioning anchor 24*a* rests upon a surface 42 of mounting plate 14. The engagement of the pair of complementary positioning anchors 24*a* and 24*b* secure the display 10 in a position such that the sign is displayed at an angle of about 115 degrees relative to the generally flat surface upon which mounting plate 14 is resting.

The multi-positionable display 10 illustrated in FIGS. 1–5 may be manufactured as an extruded plastic material, with the hinge 18, sign holder 20, and mounting plate 14 manufactured in one process. The hinge 18 may be manufactured of a material with a sufficient thickness and density so as to allow the sign holder 20 to pivot freely in relation to the mounting plate 14. The sign holder 20 may be manufactured such that the surfaces 30 and 32, which define u-shaped channel 31*a*, are of a sufficient rigidity and thickness so as to allow a sign inserted into channel 31*a* to remain upright. Likewise, mounting plate 14 must also have a sufficient rigidity and thickness to securely couple display 10 to a surface.

Figure 6:
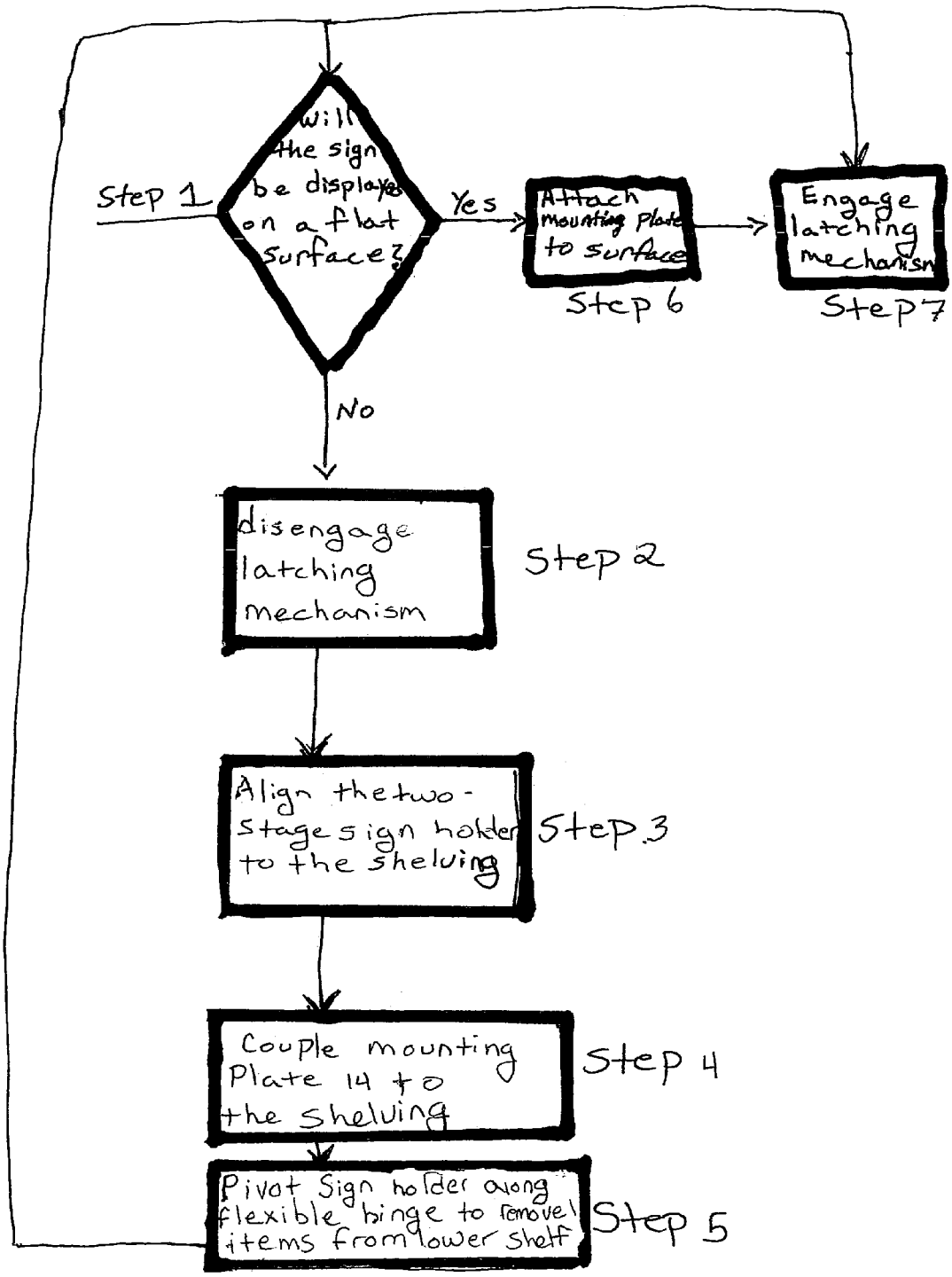
FIG. 6 is a diagramatic illustration of an exemplary method of using the multi-positionable display according to principles of the present invention.

In operation, with reference to FIGS. 1–6, the multi-positionable display 10 according principles of the present invention allows a retailer to minimize the types of signs used to advertise goods. With reference to FIG. 6, the user first selects which position the display 10 may be displayed (step 1). One exemplary position allows the retailer to hang the sign from store shelving, thus maximizing space while still allowing goods to be removed from the shelving below due to the flexible nature of the display 10 (Steps 2–5). First, the latching mechanism 22 is disengaged, allowing the sign holder 20 to swing back and forth relative to the mounting plate 14 (Step 2). Second, the surface 26 of complementary positioning anchor 24*b* is aligned relative to the front face of the shelving (Step 3). Third, the mounting plate is coupled to the shelving (Step 4). In a hanging position, the flexible hinge 18 allows the sign holder 20 to be pivoted from the about 90 degree angle relative to the mounting plate 14 which is coupled to a shelving apparatus, to a position that is parallel to the mounting plate 14 for the removal of goods stored below the sign (Step 5).

Still referring to FIG. 6, the multi-positionable display 10 may also display a sign on a generally flat surface (Steps 6–7). First, the mounting plate is attached to a generally flat surface (Step 6). Second, complimentary positioning anchor 24*b* is engaged with complimentary positioning anchor 24*a* of the latching mechanism 22 (Step 7). According to principles of the present invention, this engagement of the complementary positioning anchors 24*a* and 24*b*, allows the sign to be displayed at an angle of about 115 degrees relative to the generally flat surface.

The flexibility of positioning the multi-positionable display 10 is advantageous in a retail setting because it allows a retailer to use one display system for a variety of display arrangements. In the exemplary embodiment illustrated in FIGS. 2B and 3, the flexible hinge 18 allows a retailer to restock shelves or remove goods from a store shelf without removing the display 10 from the shelving system. Further, the display 10 allows a retailer to standardize their displays so as to minimize the costs of maintaining a variety of display systems.

Principles of the invention being thus described, it will be obvious that the same may be applied in many ways. Such applications of principles of the invention are not to be regarded as a departure from the spirit and scope of the invention, which is intended to be defined by the following claims.

What is claimed is:

1. A multi-positionable display apparatus, comprising:

a mounting plate;

a flexible hinge extending at least partially along a width of said mounting plate;

a sign holder coupled to said mounting plate by said flexible hinge;

a latching mechanism extending at least partially along adjacent borders of said sign holder and said mounting plate, and adapted for positioning of said sign holder in at least two positions relative to said mounting plate;

said latching mechanism being comprised of a pair of complimentary positioning anchors, with one of said positioning anchors coupled along said adjacent borders of said sign holder and said mounting plate; and said apparatus including said pair of complimentary positioning anchors further comprising an extruded plastic compound.

2. The apparatus according to claim 1, wherein said latching mechanism positions said sign holder at an angle of about 115 degrees relative to said mounting plate when said latching mechanism is engaged and said apparatus is displayed on a flat surface.

3. The apparatus according to claim 1, wherein said latching mechanism positions said sign holder at an angle of about 90 degrees relative to said mounting plate when said latching mechanism is disengaged and said sign holder is hanging from said mounting plate.

4. The apparatus according to claim 1, wherein said apparatus is extruded as a single apparatus during said manufacture of said apparatus.

5. The apparatus according to claim 1, wherein said mounting plate further includes a plurality of holes for affixing said mounting plate to at least one surface.

6. The apparatus according to claim 5, wherein said sign holder comprises a generally u-shaped channel adapted for receipt of a sign and extending at least partially along a length of said sign holder;

wherein said generally u-shaped channel is defined between a first surface and a second surface; and wherein said first surface and said second surface are adapted to allow said sign inserted into said u-shaped channel to remain upright.

7. The apparatus according to claim 1, wherein at least one of said positioning anchors aligns said sign such that said sign is generally parallel to an edge of said surface when said sign holder is hanging from said mounting plate.

8. A method for displaying a sign, comprising the steps of:

forming a multi-positionable display from an extruded plastic compound to comprise a mounting plate, a flexible hinge extending at least partially along a width of said mounting plate, a sign holder coupled to said mounting plate by said flexible hinge, and a latching mechanism, wherein said latching mechanism extends at least partially along adjacent borders of said sign holder and said mounting plate;

forming said latching mechanism to comprise a pair of complimentary positioning anchors, with one of said positioning anchors coupled along said adjacent borders of said sign holder and said mounting plate;

securing said sign to said sign holder;

securing said mounting plate to a surface;

positioning said sign into one of at least two positions relative to said mounting plate; and said multi-positionable display including said latching mechanism having said pair of complimentary positioning anchors is comprised of said extruded plastic compound.

9. The method according to claim 8, further comprising the step of securing said sign to said sign holder having a generally u-shaped channel which extends throughout a width of said u-shaped channel;

wherein said generally u-shaped channel is defined between a first surface and a second surface; and wherein said first surface and said second surface are adapted to allow said sign inserted into said u-shaped channel to remain upright.

10. The method according to claim 8, wherein said step of securing said mounting plate to a surface further comprises securing said mounting plate to a shelving system commonly found in grocery stores and retail department stores.

11. The method according to claim 8, wherein said step of securing said mounting plate to a surface further comprises securing said mounting plate to a generally flat surface.

12. The method according to claim 8, wherein said step of securing said mounting plate to a surface further comprises securing said mounting plate to a surface of a wall.

13. The method according to claim 8, wherein said step of positioning said sign further comprises engaging said pair of complimentary positioning anchors of said latching mechanism.

14. The method according to claim 13, wherein said step of positioning said sign further comprises engaging a latching mechanism such that said sign is displayed at an angle of about 115 degrees relative said mounting plate.

15. The method according to claim 8, wherein said step of positioning said sign further comprises disengaging said pair of complimentary positioning anchors of said latching mechanism.

16. The method according to claim 15, wherein said step of positioning said sign further comprises disengagement of said latching mechanism, such that said positioning anchors located on adjacent peripheries of said sign holder and said mounting plate maintain said sign at an angle of about 90 degrees relative to said mounting plate when said sign is freely hanging from said mounting plate.

17. The method according to claim 15, wherein said step of positioning said sign freely hanging from said mounting plate further comprises aligning at least one edge of said latching mechanism with a corresponding edge of said surface.

18. The method according to claim 17, further comprising the step of displaying said sign in said hanging position in a generally parallel plane relative to said edge of said surface.

* * * * *